US010236590B1

(12) United States Patent
Footdale et al.

(10) Patent No.: US 10,236,590 B1
(45) Date of Patent: Mar. 19, 2019

(54) FOLDABLE SEGMENTED STRUCTURE AND DEPLOYABLE REFLECTOR ANTENNA COMPRISED THEREOF

(71) Applicants: Joseph N. Footdale, Albuquerque, NM (US); Jeremy Banik, Albuquerque, NM (US); Jeremiah Sanders, Cedar Hill, TX (US)

(72) Inventors: Joseph N. Footdale, Albuquerque, NM (US); Jeremy Banik, Albuquerque, NM (US); Jeremiah Sanders, Cedar Hill, TX (US)

(73) Assignee: The United States of America, as Represented by the Secretary of the Air Force, Washington, DC (US)

( * ) Notice: Subject to any disclaimer, the term of this patent is extended or adjusted under 35 U.S.C. 154(b) by 196 days.

(21) Appl. No.: 15/387,555

(22) Filed: Dec. 21, 2016

(51) Int. Cl.
*H01Q 15/16* (2006.01)

(52) U.S. Cl.
CPC ..... *H01Q 15/162* (2013.01); *H01Q 15/161* (2013.01)

(58) Field of Classification Search
CPC .... H01Q 15/16; H01Q 15/161; H01Q 15/162; H01Q 15/163; H01Q 15/166; H01Q 15/167
See application file for complete search history.

(56) References Cited

U.S. PATENT DOCUMENTS 2,572,430 A * 10/1951 Balton ..... H01Q 3/08 248/121
3,176,303 A 3/1965 Holland
3,717,879 A * 2/1973 Ganssle ..... H01Q 15/162 343/915
4,769,647 A * 9/1988 Herbig ..... H01Q 15/161 343/915
7,009,578 B2 * 3/2006 Nolan ..... H01Q 1/08 343/897

(Continued)

OTHER PUBLICATIONS

Keller, P. et. al., "Development of Elastic Memory Composite Stiffeners for a Flexible Precision Reflector," Composites in Manufacturing, 2nd Quarter 2007 vol. 23 No. 2, 20 pages.

(Continued)

*Primary Examiner* — Dameon E Levi
*Assistant Examiner* — Jennifer F Hu
(74) *Attorney, Agent, or Firm* — James M. Skorich

(57) ABSTRACT

A foldable segmented structure includes a substantially center portion and a plurality of strut assemblies radially disposed around the center portion. Each strut assembly includes an inner and outer strut. The inner strut includes a first end portion rotatably coupled at the center portion and a second end portion rotatably coupled to the outer strut at an intermediate portion of the strut assembly. The intermediate portion is spaced apart from the center portion. At least one shell segment is disposed on at least one of the inner and outer strut. Each inner strut is configured to rotatably articulate about the first end portion in a first angular direction. Each outer strut is configured to rotatably articulate about the second end portion in a second angular direction opposite to the first angular direction to form an axially extending structure from the center portion to the intermediate portion in a stowed configuration.

12 Claims, 8 Drawing Sheets

(56) References Cited

U.S. PATENT DOCUMENTS 7,098,867 B1 * 8/2006 Gullapalli ..... H01Q 1/288
343/840
8,384,613 B1 * 2/2013 Murphey ..... H01Q 15/161
343/880

OTHER PUBLICATIONS

Murphey, T. W., "Historical Perspectives on the Development of Deployable Reflectors," 50thAIAA/ASME/ASCE/AHS/ASC Structures, Structural Dynamics, and Materials Conference, Palm Springs, CA, May 2009, 28 pages.
Datashvili, L., et al., "Large Shell-Membrane Space Reflectors," 51stAIAA/ASME/ASCE/AHS/ASC Structures, Structural Dynamics, and Materials Conference, Orlando, FL, Apr. 2010, 8 pages.

* cited by examiner 108
118
126
124
120
138
300
110
128
112
106
134
122
A1

118
164
160
126
134
A2
108
110
138
128
A
D
S 102
148
138
172
118
110
128
104
134
108
112
122
106
R 120
410
106
420
400
D

A2
D
S

178
C1
A
176
104
A2
A1
R
D
S 110
104
102
170
118
108
112
106
116
120
100
S

FOLDABLE SEGMENTED STRUCTURE AND DEPLOYABLE REFLECTOR ANTENNA COMPRISED THEREOF

GOVERNMENT INTEREST

The invention described herein may be manufactured and used by or for the Government of the United States for all government purposes without the payment of any royalty.

TECHNICAL FIELD

The embodiments herein generally relate to a foldable segmented structure, and more particularly to a deployable reflector antenna comprised of a foldable segmented structure.

BACKGROUND

Deployable radio frequency (RF) reflector antennas have been used on spacecraft for several decades to serve communications and radar missions. An important consideration for space-to-ground and ground-to-space communications is that the larger the spacecraft antenna, the more discrete the ground receiver antenna can be for a given communications link budget. In many cases these large antennas must be folded to fit inside the booster during launch then autonomously unfolded once in space.

The above information disclosed in this Background section is only for enhancement of understanding of the background of the disclosure and therefore it may contain information that does not form any part of the prior art nor what the prior art may suggest to a person of ordinary skill in the art.

SUMMARY

In view of the foregoing, an embodiment herein provides a foldable segmented structure comprising: a substantially center portion; a plurality of strut assemblies radially disposed around the substantially center portion, wherein each strut assembly comprises an inner strut and an outer strut, the inner strut comprises a first end portion rotatably coupled at the substantially center portion and a second end portion rotatably coupled to the outer strut at an intermediate portion of the strut assembly, wherein the intermediate portion is spaced apart from the substantially center portion. The foldable segmented structure further comprises at least one shell segment disposed on at least one of the inner strut and the outer strut, wherein each inner strut is configured to rotatably articulate about the first end portion in a first angular direction and each outer strut is configured to rotatably articulate about the second end portion in a second angular direction opposite to the first angular direction to form an axially extending structure from the center portion to the intermediate portion in a stowed configuration. The at least one shell segment may comprise a curved front surface. Each strut assembly may further comprise an intermediate strut interposed between the inner strut and the outer strut, wherein the intermediate strut may comprise a first intermediate end rotatably coupled to the second end portion, and a second intermediate end opposite to the first intermediate end rotatably coupled to a proximate end of the outer strut, and wherein the second intermediate end may be configured to rotatably articulate about the second end portion in the second angular direction and the outer strut may be configured to rotatably articulate about the second intermediate end in a third angular direction opposite to the second angular direction to form an axially extending structure from the center portion to the intermediate portion in the stowed configuration. The at least one shell segment may comprise a plurality of shell segments comprising an inner shell segment and an outer shell segment, and wherein the inner shell segment may be disposed on the inner strut and the outer shell segment may be disposed on the outer strut. The at least one shell segment may comprise a stiffness resiliency to elastically store strain energy of the at least one shell segment in the stowed configuration. The at least one shell segment may be configured to release the stored strain energy to deploy the plurality of strut assemblies radially outward from the stowed configuration. The at least one shell segment may comprise a reflector surface configured to reflect electromagnetic energy to a focal region in the deployed configuration.

Another embodiment provides a structure configured to articulate between a plurality of positions, the structure comprising: a substantially central portion; and a plurality of shell assemblies radially disposed around the substantially central portion, each shell assembly comprising an inner shell segment comprising a first end portion rotatably connected at the substantially central portion, a second end portion rotatably connected to an outer shell segment at an intermediate portion of the shell assembly, and inner side portions increasingly spaced apart and outwardly extending from the first end portion to the second end portion, wherein the intermediate portion is spaced apart from the central portion, and the outer shell segment comprising a proximate end portion rotatably connected to the second end portion, and outer side portions increasingly spaced apart and outwardly extending from the proximate end portion to a terminal end portion of the outer shell segment, wherein the inner shell segment is configured to rotatably articulate in a first angular direction at a substantially constant circumferential angle about the first end portion to circumferentially overlap the inner side portions with adjacent inner shell segments, and wherein the outer shell segment is configured to rotatably articulate about the second end portion in a second angular direction opposite to the first angular direction to circumferentially overlap the outer side portions with adjacent outer shell segments. The inner shell segment may further comprise an inner strut disposed on a back surface of the inner shell segment, and wherein the inner strut may comprise the first end portion rotatably connected to a first end of an adjacent inner shell segment in the substantially central portion. The outer shell segment may further comprise an outer strut disposed on a back surface of the outer shell segment, and wherein the outer strut may comprise a proximate end portion operatively connected to the inner shell segment at the intermediate portion of the shell assembly. At least one of the inner shell segment and the outer shell segment may comprise a curved surface comprising a first curvature on a front surface. At least one of the inner shell segment and the outer shell segment may comprise a dual curved surface comprising a second curvature on the front surface. Each shell assembly may comprise a curved surface comprising a complex curvature on a front surface. At least one of the inner shell segment and the outer shell segment may comprise a stiffness resiliency to elastically store strain energy of the respective the inner shell segment and the outer shell segment when respective inner side portions with adjacent inner shell segments and outer side portions with adjacent outer shell segments may be disposed to overlap by a restraining force, and wherein the at least one of the inner shell segment and the outer shell segment may be configured to release the stored strain energy to deploy the plurality of shell assemblies radially outward from the overlap position when the restraining force is withdrawn. The at least one of the inner shell segment and the outer shell segment may be configured to release the stored strain energy to deploy the at least one of the inner shell segment and the outer shell segment to a predetermined curvature. The plurality of radially disposed shell assemblies may be configured to articulate between a first configuration of a parabolic surface structure and a second configuration of a cylindrical folded structure. The inner shell segment rotated in the first angular direction may be disposed to extend in a substantially axial direction substantially transverse to the substantially central portion and the outer shell segment rotated in the second angular direction may be disposed to extend in the substantially axial direction, and wherein the terminal end portion may be disposed substantially adjacent to the first end portion. The structure may further comprise a constraint to restrain the outer shell segment in the axial position to form a cylindrical folded structure, wherein the inner side portions comprise a first angularly increasing perimeter extending in the radial direction from the substantially central portion, wherein the outer side portions comprise a second angularly increasing perimeter extending in the radial direction from the intermediate portion, wherein the each shell assembly may comprise an outwardly extended shape comprised of the first and second angularly increasing perimeters, and wherein the second angularly increasing perimeter may be disposed in an axial spiral in the cylindrical folded structure. The plurality of radially disposed shell assemblies may be configured to reflect electromagnetic energy at a focal region.

Another embodiment provides a deployable parabolic antenna comprising: a strut assembly configured to articulate between a first configuration and a second configuration; and a plurality of shell segments comprising a substantially parabolic arrangement disposed on the strut assembly in the first configuration, and a substantially cylindrical arrangement disposed on the strut assembly in the second configuration, wherein the substantially cylindrical arrangement comprises the parabolic arrangement folded along a circumferential intermediate portion disposed between a vertex portion of the parabolic arrangement and a maximum diameter edge of the parabolic arrangement, wherein a first portion of the plurality of shell segments is disposed between the vertex portion and the intermediate portion and a second portion of the plurality of shell segments is disposed between the intermediate portion and the edge, and wherein the first portion of the plurality of shell segments are disposed substantially adjacent the second portion of the plurality of shell segments in the second configuration.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1A:
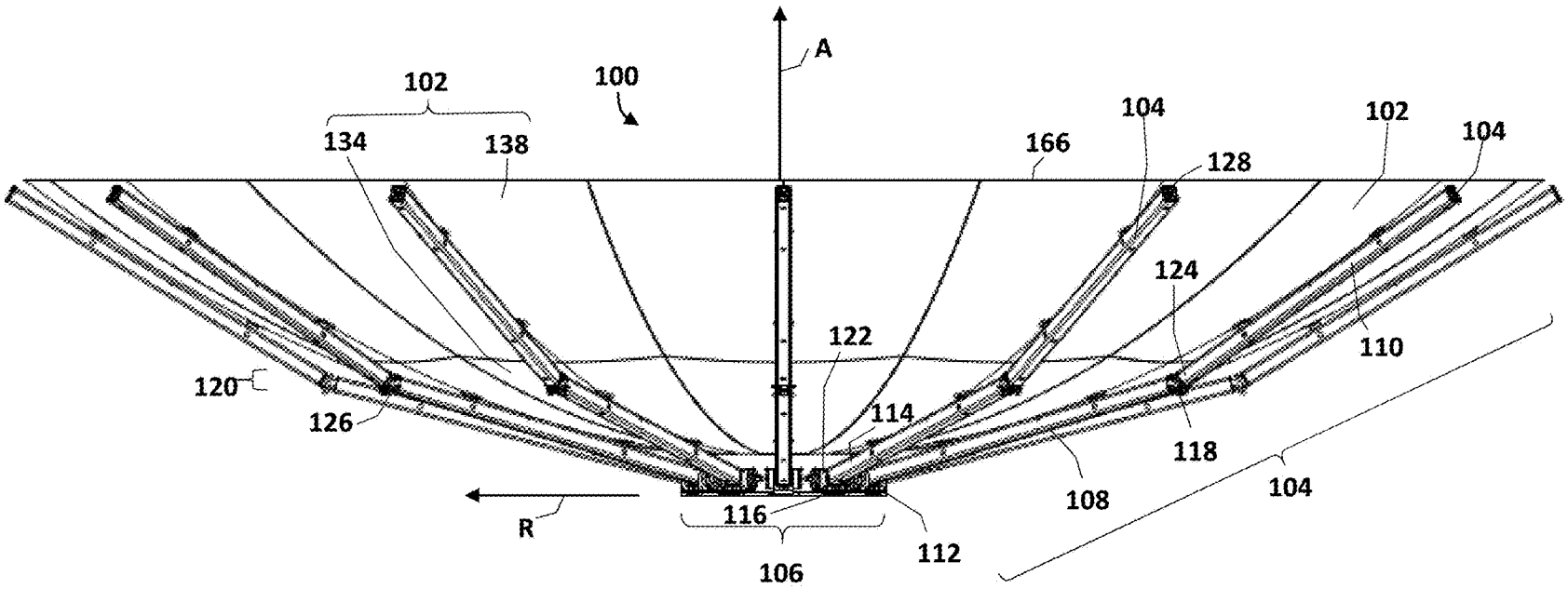
FIG. 1A is a schematic diagram of a side perspective view illustrating a deployed structure, such as a reflector antenna according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

It will be understood that when an element or layer is referred to as being "on", "connected to", or "coupled to" another element or layer, it can be directly on, directly connected to, or directly coupled to the other element or layer, or intervening elements or layers may be present. In contrast, when an element or layer is referred to as being "directly on", "directly connected to", or "directly coupled to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

In the drawings, the size and relative sizes of layers and regions may be exaggerated for clarity. Referring now to the drawings, and more particularly to FIGS. 1A through 7D, where similar reference characters denote corresponding features consistently throughout the figures, there are shown exemplary embodiments.

FIGS. 1A through 3C show various views of a foldable segmented reflector structure 100 in accordance with the embodiments herein. FIG. 1A is a schematic diagram of a side perspective view illustrating a deployed structure 100 according to an embodiment herein. FIG. 1B is a schematic diagram of a front-side perspective view illustrating the deployed structure 100 of FIG. 1A comprised of radial shell assemblies 102 disposed on strut assemblies 104. Referring to FIGS. 1A and 1B, the illustrated structure 100 comprises a dish structure, which may be useful as a reflector, for example, a parabolic reflector, a radio frequency (RF) antenna, and the like, and includes a substantially center region 106 about which radially extending strut assemblies 104 are arranged in a deployed configuration of the structure 100. The radially extending strut assemblies 104 extend in the radial direction "R" and in an axial direction "A" to support the desired arrangement of the overall structure 100. Each strut assembly 104 in the illustrated embodiment is made up of an inner strut 108 and an outer strut 110. However, each strut assembly 104 may comprise additional struts (not shown) disposed between the inner strut 108 and the outer strut 110.

The inner strut 108 is rotatably coupled at its first end 112 to an adjacent inner strut 114 at its first end 116 in the substantially center region 106, and a second end 118 of the inner strut 108 is rotatably coupled to the outer strut 110 at an intermediate region 120 of the strut assembly 104. The substantially center region 106 may comprise rotatable couplings 122 between the first ends 112 of the inner struts 108 and first ends 116 of adjacent inner struts 114, such as hinges, referred to herein in some instances as root hinges 122. The couplings 122 may form a ring of three or more, for example, 12 couplings 122 in the substantially center region 106, or a rigid structure, such as a ring structure, a disc structure, a plate structure, a frame structure, or the like, and combinations thereof, may provide support for the couplings 122. Each coupling 122 provides an anchor for each strut assembly 104 to be coupled to the other strut assemblies 104 or for each strut assembly 104 to be coupled to a common rigid structure, as mentioned. While each coupling 122 provides an anchor for each strut assembly 104 to be coupled to the other strut assemblies 104, each strut assembly 104 can articulate about each coupling 122 independently. That is, each inner strut 108 rotatably coupled at its first end 112 to an adjacent inner strut 114 at its first end 116 can rotate about its own first end 112 independently of the adjacent inner strut 114.

The intermediate region 120 is spaced apart from the substantially center region 106 where second ends 118 of the inner struts 108 are rotatably coupled to proximate ends 124 of the outer struts 110. The second ends 118 of the inner struts 108 can be rotatably coupled to proximate ends 124 of the outer struts 110 by intermediate hinges 126 and the outer struts 110 can extend radially outward therefrom to terminal ends 128 in the illustrated deployed configuration of the structure 100. The struts 108, 110 are not particularly limited and can be tubes, for example, polygonal, curved or combinations thereof in cross-section, such as C-channels, D-channels, I-beams, bars, rods, open-structured, closed-structure, and the like, or combinations thereof.

Where each strut assembly 104 comprises an additional strut disposed between the inner strut 108 and the outer strut 110, referred to herein as an intermediate strut (not shown), the intermediate strut can have a first intermediate end rotatably coupled to the second end 118 of the inner strut 108 and a second intermediate end opposite to the first intermediate end rotatably coupled to the proximate end 124 of the outer strut 110.

Figure 1B:
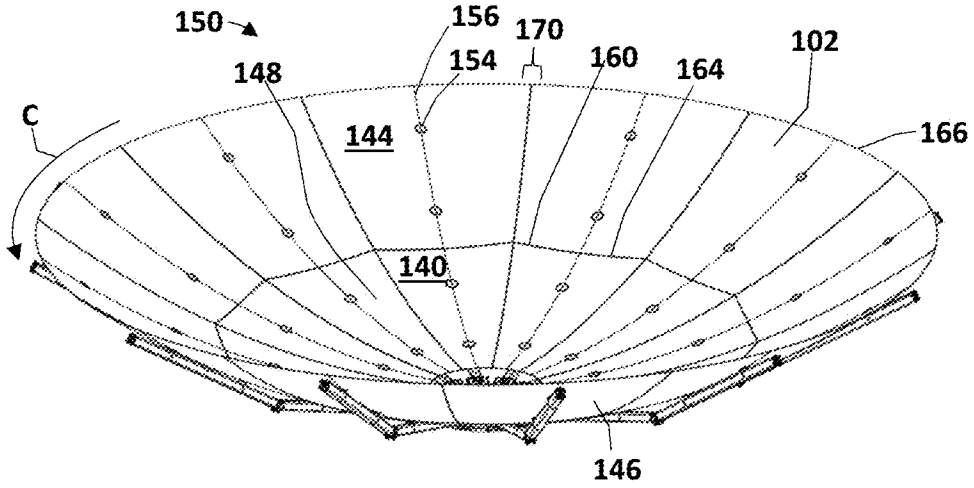
FIG. 1B is a schematic diagram of a front-side perspective view illustrating the deployed reflector antenna of FIG. 1A comprised of radial shell assemblies disposed on strut assemblies according to an embodiment herein.
Figures 2A, 2B:
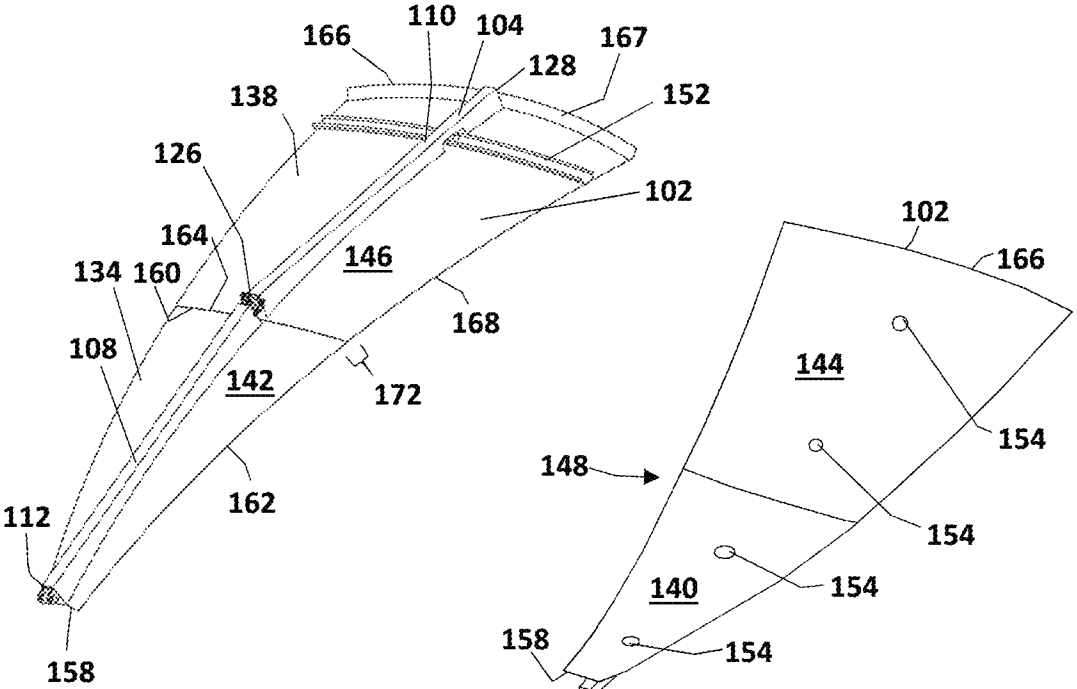
FIG. 2A is a schematic diagram of a back perspective view of a strut assembly including shell segments, such as shown in FIGS. 1A and 1B according to an embodiment herein.
FIG. 2B is a schematic diagram of a front perspective view of the strut assembly including shell segments shown in FIG. 2A according to an embodiment herein.

FIGS. 2A and 2B, with reference to FIGS. 1A and 1B, are schematic diagrams of a back perspective view and a front perspective view, respectively, of the strut assembly 104 including an inner shell segment 134 and an outer shell segment 138 according to an embodiment herein The inner strut 108 can be a substantially straight beam having a narrow cross-section and extending along a length between first end 112 and second end 118; likewise, outer strut 110 can be a substantially straight beam having a narrow cross-section and extending along a length between proximate end 124 and terminal end 128. In contrast, the inner shell segment 134 can be a large surface area structure comprising a curved front surface 140 and a curved back surface 142 substantially parallel to the front surface 140 and spaced apart therefrom by thin edges.

Likewise, the outer shell segment 138 can comprise a large surface area structure comprising a large curved front surface 144 and a large curved back surface 146 substantially parallel to the front surface 144 and spaced apart therefrom by thin edges. When the inner shell segment 134 and the outer shell segment 138 are deployed radially outward, the inner shell segment 134 front surface 140 and the outer shell segment 138 front surface 144 form an integral front segment surface 148. A plurality of the integral front segment surfaces 148 disposed radially extending in the deployed configuration arranged about the substantially center portion 106 provide an integral front surface 150 of the foldable segmented reflector structure 100.

The integral front surface 150 can have various curvatures, for example, a constant radius curvature, or a non-constant radius curvature, such as a complex curvature, a parabolic curvature described by a parabolic equation, a compound curvature, and the like, or combinations thereof. For example, the inner shell segment 134 can have a curved front surface 140 having a first curvature. For example, the first curvature can be a constant radius of curvature, but need not be so limited, for example, the first curvature may not have a constant radius, instead it may have a complex curvature, a parabolic curvature, a compound curvature, and the like, or combinations thereof. In some embodiments, the inner shell segment 134 can have a curved front surface 140 having a second curvature. When the inner shell segment 134 front surface 140 has a first curvature and a second curvature, it can be referred to as having dual curvature, having a "non-developable" surface, or a surface with "compound curvature". For example, the outer shell segment 138 can have a curved front surface 144 having a first curvature. For example, the first curvature can be a constant radius of curvature, but need not be so limited, for example, the first curvature may not have a constant radius, instead it may have a complex curvature, a parabolic curvature, a compound curvature, and the like, or combinations thereof. In some embodiments, the outer shell segment 138 can have a curved front surface 144 having a second curvature. When the outer shell segment 138 front surface 144 has a first curvature and a second curvature, it can be referred to as having dual curvature, having a "non-developable" surface, or a surface with "compound curvature".

The integral front surface 150 comprised of the inner shell segment 134 curved front surfaces 140 and the outer shell segment 138 curved front surfaces 144 can have a predetermined curvature. For example, the inner shell segment 134 front surfaces 140 and the outer shell segment 138 front surfaces 144 can be coordinated to provide a paraboloid reflector shape such that the integral front surface 150 has a focus point, or a spheroid reflector shape such that the front surface 150 has a focal line. Exemplary embodiments provide both of these shapes. Preferred embodiments can be a symmetric paraboloid surface shape 150, and a circumferentially non-symmetric curvature, for example, spheroid and/or paraboloid surface shape 150. A non-symmetric shape can focus electromagnetic energy to a location other than at the center of the reflector, referred to as an off-set reflector. The integral front surface 150 can have dual curvature or single curvature to provide reflection to a focal region such as desired for a reflector antenna. That is, the curvature or the dual curvature of the inner shell segment 134 front surfaces 140 and the outer shell segment 138 front surfaces 144 can be coordinated to provide the integral front surface 150 with the predetermined desired integral curvature, or predetermined desired integral dual curvature.

The inner shell segment 134 and the outer shell segment 138 can be comprised of a stiff, resilient material to elastically store strain energy when deformed by a load, such as a constraint (see, for example, shroud restraint 710 in FIGS. 6 and 7D) and return to a predetermined manufactured shape when the constraint is removed. The inner shell segment 134 and the outer shell segment 138 may comprise stiff, resilient material and can be self-supporting to maintain the predetermined shape, including the curved front surfaces 140, 144. The inner shell segment 134 and the outer shell segment 138 can be, for example, a spring steel, a beryllium copper spring material, a laminar spring composite, a fiber reinforced composite, and the like, or combinations thereof.

For example, a thin carbon fiber reinforced polymer (CFRP) shell segment comprising three layers of Intermediate Modulus (IM) carbon fiber epoxy plain weave in a [±45 0/90±45] orientation may be used in accordance with the embodiments herein. The 0° direction is taken to be along the radial direction of the shell section. The resulting shape of cured, thin laminates has been shown to be sensitive to laminate symmetry and fiber orientation. The tooling for the shell segments may be constructed from a CFOAM® core (available from Carbon Innovations, LLC) with BMI® tooling prepreg (available from Cytec Industries Inc.) for the surface. The low coefficient of thermal expansion can minimize tooling thermal deformations during exposure to the 350° F. (177° C.) cure process.

Rib-like reinforcements 152 of the same material can be disposed on the back of at least some of the shell segments 134, 138, for example, collapsible ribs 152 on the backside to aid in deployed stiffness, wherein such ribs 152 generally run transverse to the struts 108, 110, and can be constructed of a similar stiff resilient material as the shell segments allowing the reinforcements to be folded/collapsed during stowage and unfolded by their own stored elastic strain energy.

As illustrated, the strut assembly 104 connects to the shell assembly 102 at predetermined positions, such as two or more fastener positions 154 for each shell segment 134, 138 along a centerline 156 of the shell segments 134, 138 at corresponding positions of the struts 108, 110. The struts need not be curved to support a reflective surface as the shell segments are pre-formed in such a curved shape to provide the reflective surface and retain this curvature. In some embodiments the struts are not required and the inner shell segment 134 can rotatably couple to an adjacent inner shell segment and the inner shell segment 134 can rotatably couple to the outer shell segment 138. In some embodiments, at least one shell segment 134, 138 is located on each strut assembly 104 on at least one of the inner strut 108 and the outer strut 110, for example, a shell segment 134, 138 is located on both of the inner and outer struts 108, 110, but in some situations a shell segment 134, 138 may be omitted.

The intermediate strut, as mentioned above can have an intermediate shell segment disposed thereon (not shown). Such an intermediate shell segment can be disposed between the inner shell segment 134 and the outer shell segment 138 and together with the inner shell segment 134 front surface 140 and the outer shell segment 138 front surface 144 can be coordinated to provide the integral front surface 150 with the predetermined desired integral radius of curvature, or predetermined desired integral dual radius of curvature.

The inner shell segment 134 can have a narrow first edge 158 disposed in the substantially center portion 106 and a second edge 160 broader than the first edge 158 disposed in the intermediate portion 120, with side edges 162 outwardly extending from the first edge 158 to the second edge 160. The first edge 158 and the second edge 160 can extend in circumferential direction C. The outer shell segment 138 can have a proximate edge 164 disposed in the intermediate portion 120 adjacent the second edge 160 of the inner shell segment 134, and a terminal edge 166 broader than the proximate edge 164 disposed radially outward from the intermediate portion 120 to form an outer edge 166 of the deployed structure 100. The outer shell segment 138 can have side edges 168 in line with side edges 162 of the inner shell segment 134, outwardly extending from the proximate edge 164 to the terminal edge 166. The proximate edge 164 and the terminal edge 166 can also extend in circumferential direction C. The outer shell segment 138 side edges 168 and the side edges 162 of the inner shell segment 134 meet side edges 168 of an adjacent outer shell segment 138 and the side edges 162 of an adjacent inner shell segment 134 at a side seam 170 of the integral front surface 150.

In some embodiments, the terminal edge 166 can comprise a curved skirt 167 as shown in FIG. 2A. The curved skirt 167 terminal edge 166 can provide reinforcement such as provided by rib 152, and prevent electromagnetic backscatter. The skirt 167 can be an extension of the outer shell segment 138, and fabricated of the same material. The skirt 167 can be manufactured to form a predetermined curvature when the shell 148 is deployed, but collapsed when the shell 148 is folded. The stiff resilient material of the skirt 167 can allow it to be folded/collapsed during stowage and unfolded to the predetermined curvature by its own stored elastic strain energy.

In some embodiments, the struts are not required and the inner shell segment 134 can rotatably couple to an adjacent inner shell segment in the substantially center portion at the first edge 158 and the inner shell segment 134 second edge 160 can rotatably couple to the outer shell segment 138 proximate edge 164.

In some embodiments, the intermediate shell segment can have a first intermediate edge disposed adjacent the second edge 160 of the inner shell segment 134, and a second intermediate end disposed adjacent the proximate edge 164 of the outer shell segment 138. The intermediate shell segment can have side edges in line with side edges 162, 168 of the inner shell segment 134 and the outer shell segment 138, outwardly extending from the first intermediate edge to the second intermediate edge. The first intermediate edge to the second intermediate edge can also extend in circumferential direction C.

In some embodiments, the intermediate shell segment can rotatably couple to the inner shell segment 134 at a first intermediate end and rotatably couple to the outer shell segment 138 at a second intermediate end. In some embodiments, the intermediate strut can be a series of intermediate struts, for example, a second intermediate strut can be coupled between a first intermediate strut and the outer strut 110 and rotatably connected end-to-end as described, where the first intermediate strut is rotatably connected to the inner strut 108. Likewise, each intermediate shell segment can be a series of intermediate shell segments, for example, a second intermediate shell segment can be coupled between a first intermediate shell segment and the outer shell segment 138 and rotatably connected end-to-end as described, where the first intermediate shell segment is rotatably connected to the inner shell segment 134.

Figures 3A, 3B, 3C:
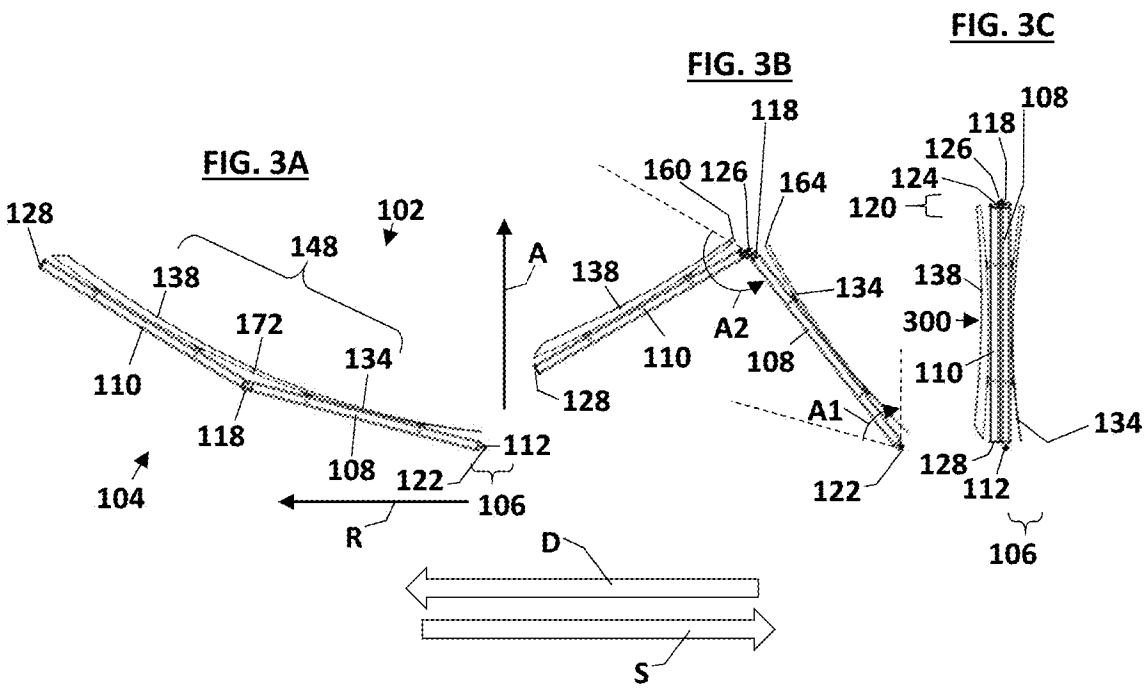
FIGS. 3A through 3C are a series of side perspective views of a strut assembly including shell segments shown in FIGS. 2A and 2B, as it articulates between stowed and deployed arrangements according to an embodiment herein.

FIGS. 3A through 3C, with reference to FIGS. 1A through 2B, are a series of side perspective views of a strut assembly 104 including a shell assembly 102 shown in FIGS. 2A and 2B, as it articulates from deployed to stowed arrangement from left to right indicated by arrow S and articulates from stowed to deployed arrangement from right to left indicated by arrow D.

In FIG. 3A, the radially extending strut assembly 104 having radial shell assembly 102 disposed thereon is arranged in a deployed configuration of the structure 100 shown in FIGS. 1A and 1B. In FIG. 3B, the articulation of the inner strut 108 and an outer strut 110 can be seen. The inner strut 108 rotatably articulates about the first end portion 112 thereof in a first angular direction A1 and the outer strut 110 rotatably articulates about the second end portion 118 of the inner strut 108 in a second angular direction A2 opposite to the first angular direction A1 from deployed to stowed arrangement from left to right indicated by arrow S. The inner strut 108 rotatably articulates about the first end portion 112 thereof in the negative first angular direction A1 and the outer strut 110 rotatably articulates about the second end portion 118 of the inner strut 108 in the negative second angular direction A2.

As mentioned above, a rotatable coupling 122 may be disposed at the first end portion 112, such as a hinge, referred to herein in some instances as a root hinge 122 to rotate the inner strut 108 about the first end portion 112. The inner strut 108 can rotate about the first end portion 112 in the first angular direction A1 at a substantially constant circumferential angle. The root hinge 122 can have a rotation limit, such as a stop member (not shown), to hold the inner strut 108 at a predetermined angle in the deployed and/or stowed configuration. A rotatable coupling 126 may be disposed at the second end portion 118, such as a hinge, referred to herein in some instances as an intermediate hinge 126 to rotate the outer strut 110 about the second end portion 118. The outer strut 110 can rotate about the second end portion 118 in the second angular direction A2 at a substantially constant circumferential angle. A substantially constant circumferential angle refers to the inner strut 108 and outer strut 110 not moving appreciably in the circumferential direction C (FIG. 1B). The intermediate hinge 126 can have a rotation limit, such as a stop member (not shown), to hold the outer strut 110 at a predetermined angle in the deployed and/or stowed configuration.

A motive force, for example, a motor, such as an electrical motor, or a manual device, such as a hand crank, may rotate the inner strut 108 about the first end portion 112 and rotate the outer strut 110 about the second end portion 118. Lines, pulleys, gears, screws, levers, or the like, and combinations thereof, may be used in conjunction with the motive force to articulate the structure 100 from deployed to stowed configuration and/or from stowed to deployed configuration. For example, a rotation spring (not shown) located at the root hinge 122 at the base of the inner strut 112 and another located at the inner to outer strut hinge 126 can provide the motive force. These hinges 122, 126 can be synchronized to deploy at the same rate.

A gap 172 at a seam between the second edge 160 of the inner shell segment 134 and the proximate edge 164 of the outer shell segment 138 opens as the outer strut 110 rotates about the second end portion 118 in the second angular direction A2 from the deployed configuration. The gap 172 becomes narrower and may even close completely as the outer strut 110 rotates about the second end portion 118 in the negative second angular direction A2. The second edge 160 of the inner shell segment 134 may be disposed adjacent, in contact, in direct contact, overlapping, or spaced apart from the proximate edge 164 of the outer shell segment 138 in the deployed configuration of the structure 100.

As the outer strut 110 rotates further about the second end portion 118 in the second angular direction A2 and the inner strut 108 rotates further about the first end portion 112 in the first angular direction A1, the inner strut 108 aligns to the substantially axial direction A adjacent to the substantially center portion 106 and the outer strut 110 aligns substantially parallel and adjacent to the inner strut 108 in an axially extending structure 300 referred to herein as a stowed configuration as indicated in FIG. 3C. The terminal end 128 of the outer strut 110 is disposed adjacent to the first end 112 of the inner strut 108 and the proximate end 124 of the outer strut 110 is disposed adjacent and rotatably connected to the second end 118 of the inner strut 108.

The outer shell segment 138 front surface 144 is disposed radially outward in direction R from the folded-together inner strut 108 and outer strut 110, and the inner shell segment 134 front surface 140 is disposed radially opposite to the outer shell segment 138 front surface 144. As described further below, when the plurality of strut assemblies 104 are folded in the stowed configuration, having the first ends 112 rotatably connected in the center portion 106, the strut assemblies 104 form a substantially cylindrical structure (see FIG. 4D). The cylindrical structure 400 has the inner shell segments 134 front surfaces 140 disposed inward toward a central axis of the cylinder and the outer shell segments 138 front surfaces 144 form an outward facing outer periphery of the cylinder.

In some embodiments, an intermediate strut may be interposed between the inner strut 108 and the outer strut 110. In such embodiments, the first intermediate end can rotate about the second end 118 in the second angular direction A2, and the outer strut 110 can rotate about the second intermediate end in a third angular direction A3 (not shown) opposite to the second angular direction A2 and substantially constant in the circumferential direction C. In such embodiments, the intermediate strut can be disposed between, adjacent and substantially parallel to the inner strut 108 and the outer strut 110 in the stowed configuration. In some embodiments, the intermediate strut can be a series of intermediate struts, and the strut assembly 104 can accordion fold the inner strut 108, the intermediate struts (not shown) and the outer strut 110 into the axially extending stowed configuration. When an odd number of intermediate struts are used, the terminal end 128 of the outer strut 110 will be disposed adjacent the second end 118 of the first strut 108 spaced apart therefrom by corresponding intermediate strut end portions in the stowed configuration. When an even number of intermediate struts are used, the terminal end 128 of the outer strut 110 will be disposed adjacent the first end 112 of the first strut 108 spaced apart therefrom by corresponding intermediate strut end portions. When the intermediate strut has an intermediate shell segment disposed thereon, the front face of the intermediate shell segment can be disposed adjacent to the outer shell segment 138 between the outer strut 110 and the intermediate strut. When an even number of intermediate struts are used, the outer shell segment 138 front surface 144 faces radially outward in direction R as shown without the intermediate strut of FIG. 3C.

Figures 4A, 4B, 4C, 4D:
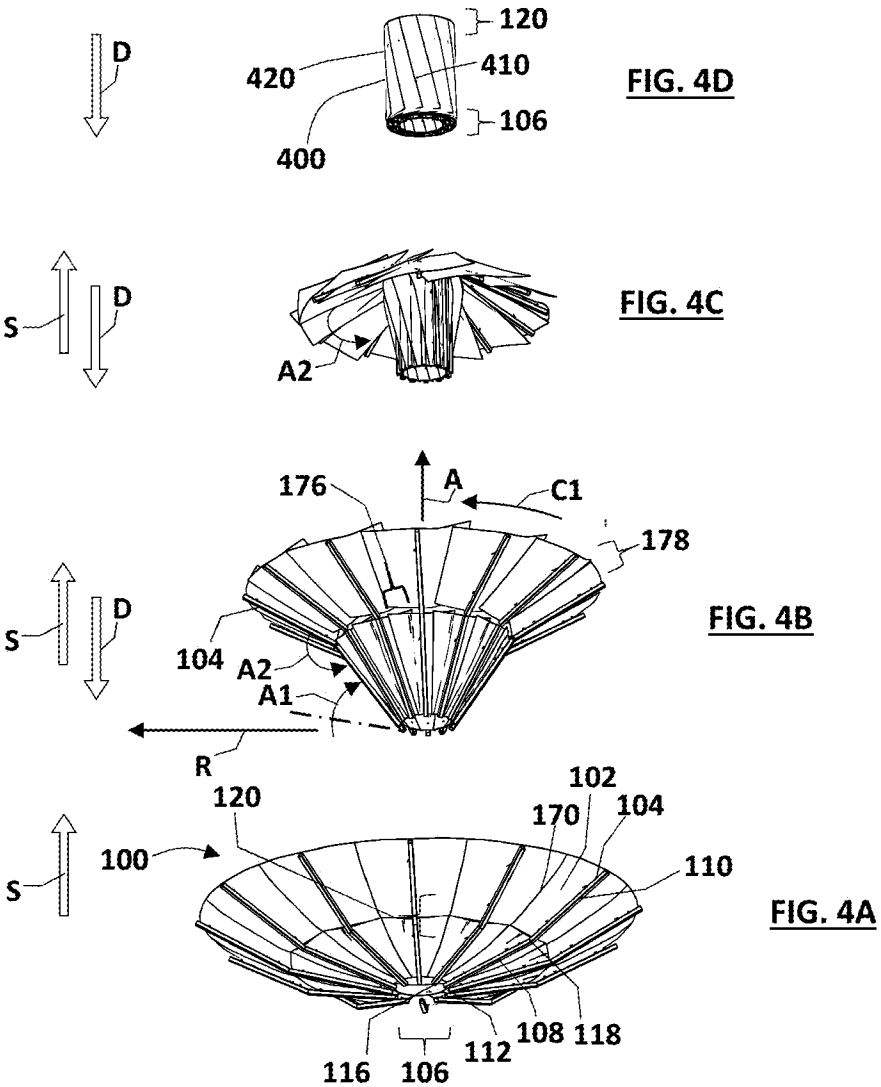
FIG. 4A is a perspective view schematic diagram illustrating a back-side of reflector antenna of FIG. 1A in the deployed configuration according to an embodiment herein.
FIG. 4B is the reflector antenna of FIG. 4A in an articulated arrangement from the arrangement shown in FIG. 4A according to an embodiment herein.
FIG. 4C is the reflector antenna of FIG. 4A in an articulated arrangement from the arrangement shown in FIG. 4B according to an embodiment herein.
FIG. 4D is the reflector antenna of FIG. 4A in an articulated arrangement from the arrangement shown in FIG. 4C, such that the structure is in a stowed configuration according to an embodiment herein.

FIGS. 4A through 4D, with reference to FIGS. 1A through 3C, are perspective view schematic diagrams illustrating a reflector antenna comprised of a plurality of strut assemblies 104 having shell assemblies 102 disposed thereon as it articulates from deployed to stowed arrangement from FIG. 4A to FIG. 4D indicated by arrow S and articulates from stowed to deployed arrangement from FIG. 4D to FIG. 4A indicated by arrow D. Each strut assembly 104 and shell assembly 102 articulates as described above with reference to FIGS. 3A through 3C, details of the inner shell segment 134 and outer shell segment 138 arrangement as the shell assemblies 102 articulate relative to adjacent shell assemblies 102, as well as details of strut assemblies 104 arrangement relative to adjacent strut assemblies 114, 115 are described with reference to FIGS. 4A through 6D.

FIG. 4A is a perspective view of the back-side of reflector antenna of FIG. 1A in the deployed configuration according to an embodiment herein. In FIG. 4B the articulation of the inner struts 108 rotatably about the first end portions 112 thereof in first angular directions A1 is shown, while the outer struts 110 have not yet rotatably articulated about the second end portions 118 of the inner struts 108 in second angular directions A2 opposite to respective first angular directions A1 from deployed to stowed arrangement from FIG. 4A to FIG. 4B indicated by arrow S. A reverse operation indicated by arrow D articulates the inner struts 108 rotatably about the first end portions 112 thereof in the negative first angular directions A1 (i.e., opposite to the first angular direction A1), while the outer struts 110 may be rotatably articulated about the second end portions 118 of the inner struts 108 in the negative second angular directions A2 (i.e., opposite to the second angular direction A2) from stowed to deployed arrangement. When the shell assemblies 102 are deployed the outer shell segment 138 side edges 168 and the side edges 162 of the inner shell segment 134 meet side edges 168 of an adjacent outer shell segment 138 and the side edges 162 of an adjacent inner shell segment 134 at a side seam 170 to form the integral front surface 150. At the side seams 170, the side edges 162, 168 may be disposed adjacent, in contact, in direct contact, overlapping, or spaced apart from the side edges 162, 168 of the adjacent shell segment 102 in the deployed configuration of the structure 100.

The articulation of the inner struts 108 rotatably about the first end portions 112 thereof in the first angular directions A1 is referred to herein as a root fold. The articulation of the outer struts 110 rotatably about the second end portions 118 of the inner struts 108 in the second angular directions A2 opposite to the respective first angular directions A1 is referred to herein as an intermediate fold.

In some embodiments, the root fold and the intermediate fold can take place simultaneously, or in any order. In a preferred embodiment, the root fold precedes the intermediate fold from deployed to stowed arrangement from FIG. 4A to FIG. 4B indicated by arrow S. The root fold includes overlap 176 of inner shell segments 134 with adjacent inner shell segments 134 in the circumferential direction as the second end portion 118 increases extension in axial direction A and decreases extension in radial direction R due to articulation about first end portion 112 in first angular direction A1. Inner shell segments 134 comprise side portions adjacent side edges 162 increasingly spaced apart and outwardly extending from the first end portion 158 to the second end portion 160, for example, a projection of a wedge or fan shape projected perpendicular to the center line 156 of the shell segment 148 as shown in FIGS. 2A and 2B. Thus, as first angular direction A1 increases, inner shell segments 134 increasingly overlap adjacent inner shell segments 134 in the circumferential direction C. In these embodiments, each inner shell segment 134 can outwardly overlap adjacent inner shell segments 134 in a first circumferential direction, such as direction C1 in FIG. 4B.

Outer shell segments 138 comprise side portions adjacent side edges 168 increasingly spaced apart and outwardly extending from the proximate end portion 164 to the terminal end portion 166, for example, a projection of a wedge or fan shape projected perpendicular to the center line 156 of the shell segment 148 as shown in FIGS. 2A and 2B. Thus, as first angular direction A1 increases, outer shell segments 138 increasingly overlap 178 adjacent outer shell segments 138 in the circumferential direction C, for example, even with no rotation about the second angular direction A2. In these embodiments, each outer shell segment 138 can outwardly overlap adjacent outer shell segments 138 in a circumferential direction C, such as the circumferential direction C1 in FIG. 4B. That is, where the inner shell segment 134 first side portion outwardly overlaps the adjacent inner shell segment 134 in the radial direction R, the corresponding outer shell segment 138 first side portion outwardly overlaps the adjacent outer shell segment 138 in the radial direction R.

FIG. 4C is the reflector antenna of FIG. 4A in an articulated arrangement from the arrangement shown in FIG. 4B. In FIG. 4C, the inner struts 108 having inner shell segments 134 disposed thereon are fully extended in the axial direction A. For example, root hinges 122 can reach a stop element limiting further rotation in the first angular direction A1 such that root fold can be considered complete for the stowed configuration. Here, the inner struts 108 are disposed in substantially axial direction A adjacent the substantial center portion 106, having the inner shell segments 134 overlapping adjacent inner shell segments 134. The inner shell segments 134 can be elastically deformed in the configuration of FIG. 4C and return to their predetermined shape upon deployment to the deployed configuration of FIG. 4A.

In FIG. 4C the outer struts 110 having outer shell elements 138 disposed thereon are shown articulated about the second end portion 118 in angular direction A2 in the intermediate fold. As second angular direction A2 increases, outer shell segments 138 increasingly overlap adjacent outer shell segments 138 in the circumferential direction C, for example, outwardly overlap in the circumferential direction opposite to circumferential direction C1 (i.e., negative C1 direction). The positions on the outer shell segment 134 disposed closer to the terminal edge 166 tend to overlap adjacent outer shell segments 138 more than those disposed closer to the proximate edge 164.

In FIG. 4D, the outer struts 110 having outer shell segments 138 disposed thereon are fully extended in the axial direction A. For example, intermediate hinges 126 can reach a stop element limiting further rotation in the second angular direction A2 such that intermediate fold can be considered complete in the stowed configuration. For example, intermediate hinges 126 can stop rotation in the second angular direction A2 when outer struts 110 are pressed adjacent inner struts 108, for example, elastically deforming the inner shell segments 134 and/or the outer shell segments 138. Here, the outer struts 110 are disposed in substantially axial direction A adjacent the inner struts 108 that are adjacent substantial center portion 106. Each terminal end 128 of the outer struts 110 is disposed adjacent to the corresponding first end 112 of the inner strut 108 adjacent the center portion 106 and each proximate end 124 of the outer strut 110 is disposed adjacent and rotatably connected to the corresponding second end 118 of the inner strut 108 at the intermediate portion 120. The outer shell segments 138 front surfaces 144 are disposed facing radially outward in direction R, and each corresponding inner shell segment 134 front surface 140 is disposed facing radially opposite to the outer shell segment 138 front surface 144.

In the stowed configuration the outer shell segments 138 overlap adjacent outer shell segments 138 and can have the front surface 144 parabolic shape flattened backwards into a cylindrical surface shape of the axially extending stowed configuration 400 of the structure. The outer shell segments 138 can be elastically deformed in the configuration of FIG. 4D and return to their predetermined shape upon deployment to the deployed configuration of FIG. 4A. In the stowed configuration 400, the side edges 168 outwardly extending from the proximate edge 164 to the terminal edge 166, are disposed in spirals 410 on the cylindrical shape axial outer perimeter 420.

Figures 5A, 5B, 5C:
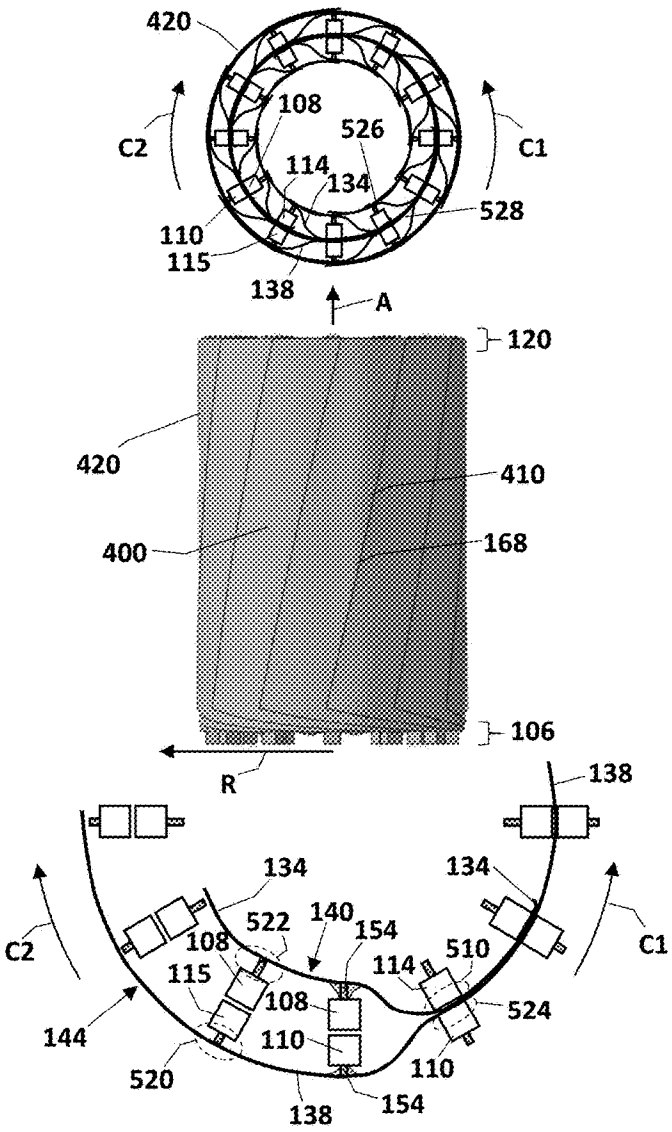
FIG. 5A is a top perspective view of several strut assemblies in the stowed configuration showing an inner shell segment outwardly overlapping in the radial direction adjacent inner struts to the left in a circumferential direction and an outer shell segment outwardly overlapping adjacent outer struts to the left, according to an embodiment herein.
FIG. 5B is a side perspective view of the structure shown in FIG. 5A in the stowed configuration illustrating the spiral arrangement of outer shell segments comprising angularly increasing perimeters according to an embodiment herein.
FIG. 5C is a top perspective view of the structure in the stowed configuration shown in FIG. 5B showing inner shell segments outwardly overlapping in the radial direction adjacent inner shell segments clockwise in a circumferential direction and outer shell segments outwardly overlapping adjacent outer shell segments clockwise according to an embodiment herein.

An embodiment of a preferred position of the inner shell segments 134 and the outer shell segments 138 in the stowed configuration 400 is further described referring to FIGS. 5A through 5C, with reference to FIGS. 1A through 4D. FIG. 5A is a top perspective view of several strut assemblies 104 in the stowed configuration 400 showing an inner shell segment 134 outwardly overlapping 510 in the radial direction adjacent inner struts 114 to the right in the first circumferential direction C1; and an outer shell segment 138 outwardly overlapping 520 in the radial direction adjacent outer struts 115 to the left in the second circumferential direction C2 according to an embodiment herein. For convenience, intermediate hinges 126 are not shown. The inner struts 108 outwardly overlap 522 in the radial direction adjacent inner shell segment 134 in the second circumferential direction C2. That is, as shown in FIG. 5C, inner shell segments 134 outwardly overlap in the radial direction adjacent inner shell segments 134 in the first circumferential direction C1 (counter clockwise). The outer struts 110 outwardly overlap 524 in the radial direction adjacent outer shell segment 138 in the first circumferential direction C1. Also, as shown in FIG. 5C, outer shell segments 138 outwardly overlap in the radial direction adjacent outer shell segments 138 in the second circumferential direction C2 (clockwise).

The circumferential direction is not particularly limiting, but the described overlap of the inner shell segments 134 is in the same circumferential direction and the described overlap of the outer shell segments 136 is in the same circumferential direction, but in the opposite direction of the inner shell segments 134. That is, for example, whether second circumferential direction C2, which appears as clockwise viewed from along the negative axial direction A (top view), or first circumferential direction C1 (counter clockwise), is not particularly limiting, rather, inner shell segments 134 outwardly overlap corresponding adjacent ones in the same first circumferential direction C1 and outer shell segments 138 outwardly overlap corresponding adjacent ones in the same second circumferential direction C2 opposite to the first circumferential direction C1. In another embodiment, for example, inner shell segments 134 outwardly overlap corresponding adjacent ones in the same second circumferential direction C2 and outer shell segments 138 outwardly overlap corresponding adjacent ones in the same first circumferential direction C1 opposite to the second circumferential direction C2.

FIG. 5B is a side perspective view of the structure shown in FIGS. 5A and 5C in the stowed configuration 400 illustrating the spiral 410 arrangement of outer shell segments 138 comprising angularly increasing perimeters 168. The plurality of strut assemblies 104 folded in the stowed configuration 400, have first ends 112 of inner struts 108 rotatably connected in the center portion 106 adjacent terminal ends 128 of the outer struts, second ends 118 of the inner strut 108 rotatably attached to proximate ends 124 of the outer struts are disposed in the intermediate portion 120 axially spaced apart from the center portion 106. The inner strut 108 and the outer strut 110 extend axially from the center portion 106 to the intermediate portion 120. The shell assemblies 102 disposed on the strut assemblies 104 form a cylindrical structure in the stowed configuration 400. The cylindrical structure has the inner shell segments 134 front surfaces 140 disposed inward toward a central axis of the cylinder structure and the outer shell segments 138 front surfaces 144 form an outward facing outer periphery 420 of the cylindrical shape axial outer perimeter.

FIG. 5C is a top perspective view of the structure in the stowed configuration shown in FIG. 5B showing inner shell segments 134 radially outwardly overlapping in the first circumferential direction C1 adjacent inner shell segments (counter clockwise) and outer shell segments 138 radially outwardly overlapping adjacent outer shell segments in the second circumferential direction C2 (clockwise) according to the embodiments herein. Radially outwardly overlapping refers to a shell segment portion being disposed radially outward relative to a portion of the adjacent shell segment disposed adjacent in the circumferential direction C1, C2. In FIG. 5C, the inner shell segment 134 is radially inwardly overlapping an adjacent inner shell segment in the second circumferential direction C2, which is to say that a portion of the inner shell segment 134 being disposed radially inward relative a portion of the adjacent inner shell 134 disposed adjacent in the second circumferential direction C2.

Furthermore, shell segments 134, 138 are connected to struts 108, 110 by fasteners 154, bonding, and the like, or combinations thereof, which indicates that the shell segments 134, 138 overlap adjacent corresponding struts 114, 115 in the same manner as the adjacent shell segments 134, 138 attached thereto as described above with reference to FIG. 5A. For example, an inner shell segment 134 first side portion adjacent a first side perimeter 162 may be disposed as an inner cylindrical surface 526 with the front surface 140 facing the axial center of the cylinder while a second side portion adjacent a second side perimeter 162 opposite the first side perimeter 162 may be disposed as an intermediate cylinder surface 528 between adjacent folded inner strut 114 and outer strut 115 with the front surface 140 facing the axial center of the cylinder. An outer shell segment 138 first side portion adjacent a first side perimeter 168 may be disposed as outer cylindrical surface 420 with the front surface 144 facing outward away from the axial center of the cylinder while a second side portion adjacent a second side perimeter 168 opposite the first side perimeter 168 may be disposed at the intermediate cylinder surface 528 between adjacent folded inner strut 114 and outer strut 115 with the front surface 140 facing outward away from the axial center of the cylinder.

Figure 6:
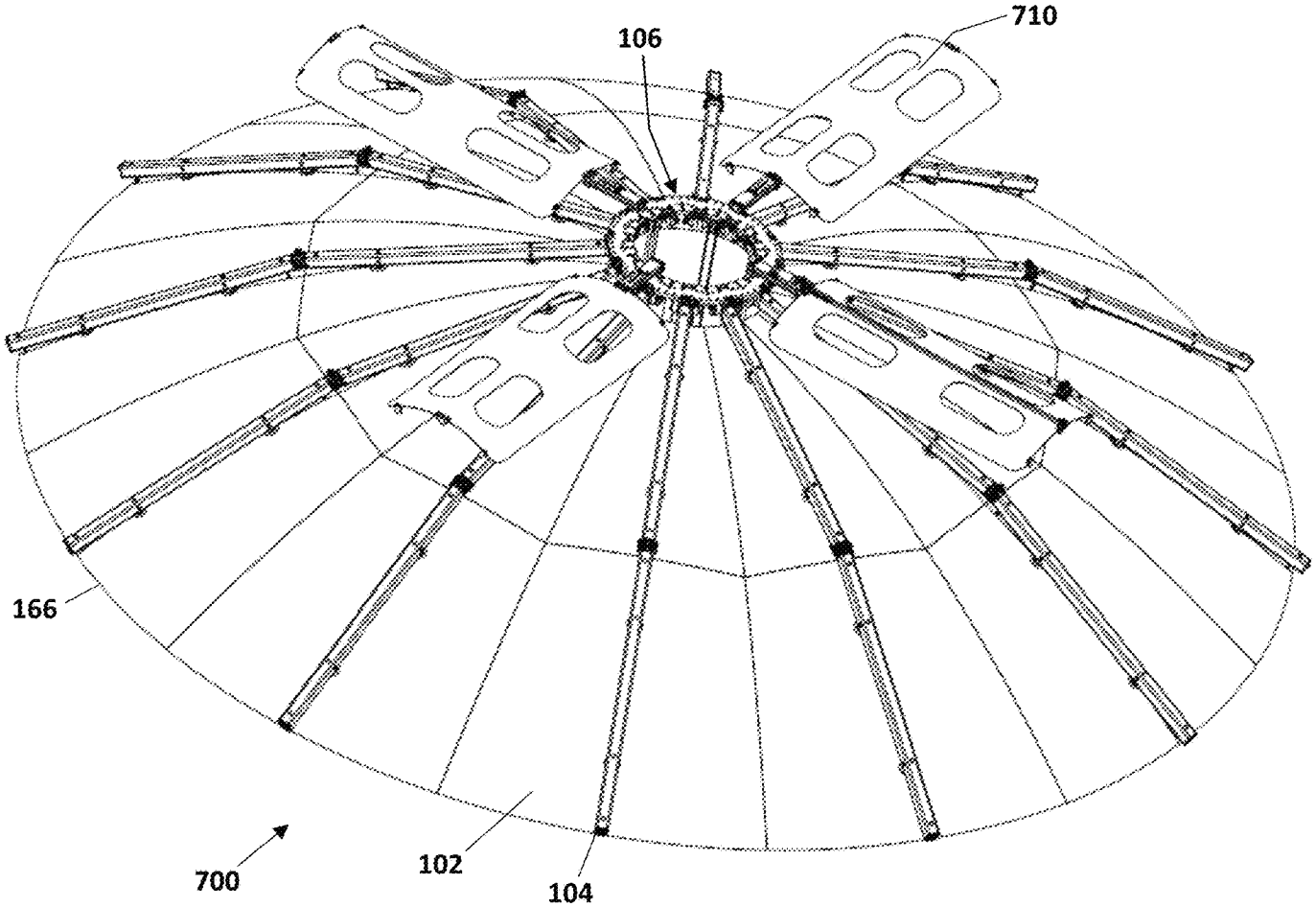
FIG. 6 is foldable segmented structure illustrating a shroud to store the structure in a stowed configuration according to an embodiment herein.

The inner shell segment 134 and the outer shell segment 138 may be elastically deformed in the stowed configuration 400. Such an elastic deformation stores strain energy that when released can partially deploy the structure from the stowed configuration 400 to the deployed configuration of the structure 100. Such a release of strain energy can provide a kick-off force to articulate the strut assemblies 104 and/or the shell assemblies 102. Release of the strain energy provides a restorative force to return the shell segments to a predetermined shape such as curved portions of a parabolic reflector. For example, the shell strain energy can provide the first few degrees of strut rotation, after which the shells have reached their fully deployed shape. A shroud, clip, strap, and the like, or combinations thereof can be disposed on the outer surface 420 of the stowed structure 400 to restrain the shell segments in the deformed elastic state. FIG. 6, with reference to FIGS. 1A through 5C, shows a foldable segmented structure 700 illustrating a shroud restraint 710 to store the structure in the stowed configuration. The shroud restraint 710 is shown in a deployed configuration comprising four sections rotatably connected in the central portion 106. The four sections of the shroud restraint 710 can form a cylindrical shape structure on the outer perimeter 420 to restrain the structure in the stowed configuration 400.

In some embodiments, the deployable parabolic antenna 100 includes a strut assembly 104 configured to articulate between a first configuration 100 and a second configuration 400. A plurality of shell segments 134, 138 are disposed on the strut assembly 108, 110 and have a substantially parabolic arrangement 150 in the first configuration 100, and a substantially cylindrical arrangement 400 on the strut assembly 104 in the second configuration 400. The substantially cylindrical arrangement 400 includes the parabolic arrangement 100 folded along a circumferential intermediate portion 120 disposed between a vertex portion 106 of the parabolic arrangement 100 and a maximum diameter edge 166 of the parabolic arrangement 100. A first portion 134 of the plurality of shell segments 134, 138 is disposed between the vertex portion 106 and the intermediate portion 120 and a second portion 138 of the plurality of shell segments 134, 138 is disposed between the intermediate portion 120 and the edge 166. The first portion of shell segments 134 is disposed substantially adjacent the second portion of shell segments 138 in the second, folded configuration 400.

Figures 7A, 7B, 7C, 7D:
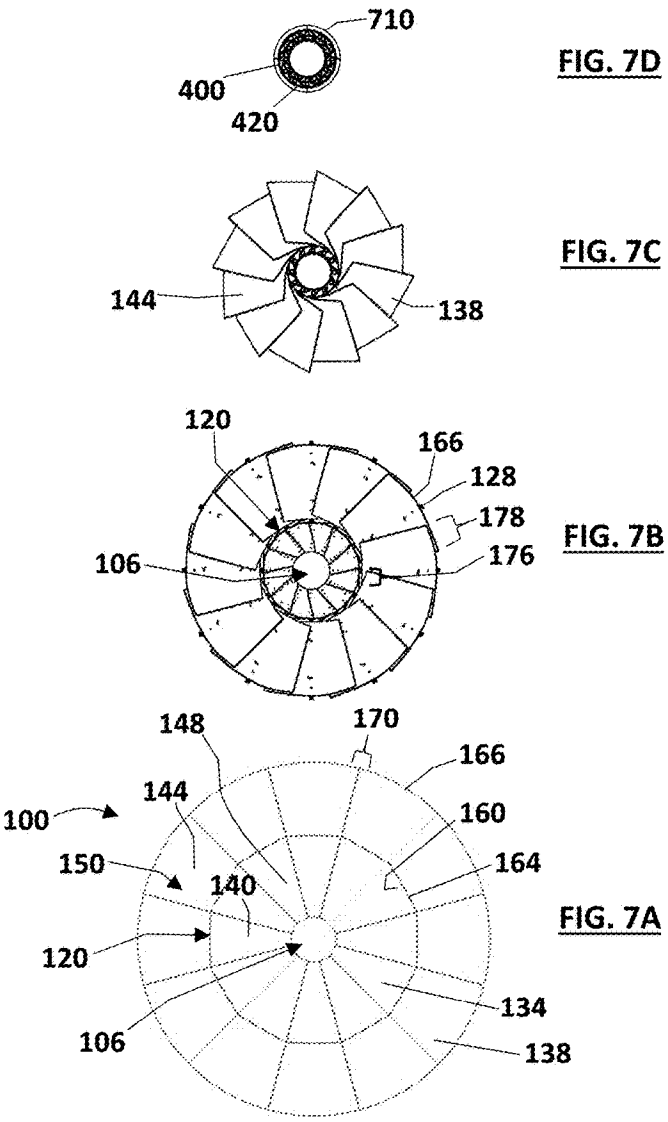
FIG. 7A is a schematic diagram of a top view illustrating foldable structure of FIG. 1A in the deployed configuration according to an embodiment herein.
FIG. 7B is a top view of the structure of FIG. 7A in an arrangement where inner shell segments have folded radially inward in a first angular direction and outer shell segments have folded radially inward in a second angular direction opposite to the first angular direction from the arrangement shown in FIG. 7A according to an embodiment herein.
FIG. 7C is a top view of the structure of FIG. 7A in an arrangement where inner shell segments have folded further in the first angular direction and outer shell segments have folded further in the second angular direction from the arrangement shown in FIG. 7B according to an embodiment herein.
FIG. 7D is a top view of the structure of FIG. 7A in an articulated arrangement from the arrangement shown in FIG. 7C, such that the structure is in a stowed configuration according to an embodiment herein.

FIGS. 7A through 7D, with reference to FIGS. 1A through 6, illustrate various views of the foldable structure 100 of FIG. 1A. FIG. 7A is a schematic diagram of a top view illustrating the foldable structure 100 of FIG. 1A in the deployed configuration according to an embodiment herein. FIG. 7B is a top view of the structure of FIG. 7A in an arrangement where inner shell segments 134 have folded radially inward in a first angular direction and outer shell segments 138 have folded radially outward in a second angular direction opposite to the first angular direction from the arrangement shown in FIG. 7A. The inner shell segments 134 overlap 176 as a result of the radially inward fold in the first angular direction. The outer shell segments 138 overlap 178 as a result of the radially inward fold in the first angular direction in FIG. 7B.

FIG. 7C is a top view of the structure 100 of FIG. 7A in an arrangement where inner shell segments 134 have folded further in the first angular direction and are disposed in a substantially axial direction from the substantially central portion 106 to the intermediate portion 120. Outer shell segments 138 have folded further in the second angular direction from the arrangement shown in FIG. 7B.

FIG. 7D is a top view of the structure 100 of FIG. 7A in an articulated arrangement from the arrangement shown in FIG. 7C, such that the structure is in a stowed configuration 400. The structure deploys in the same manner, in an opposite direction. Because the shell segments 134, 138 are overlapped throughout deployment, the deployment rotation of all radial struts is synchronized; the struts rotate together.

Embodiments herein of the deployable structure can be folded to fit inside a booster during launch then autonomously unfolded once in space. Other embodiments can include remote satellite communications from Earth; for example, the deployable structure can be folded for storage in a vehicle or backpack, etc., and then deployed for communications in highly remote locations. The embodiments herein provide for the ease of manufacturing using manufacturing techniques and materials that may be readily accessible.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A structure configured to articulate between a plurality of positions, said structure comprising:

a substantially central portion; and a plurality of shell assemblies radially disposed around said substantially central portion, each shell assembly comprising:

an inner shell segment comprising a first end portion rotatably connected at said substantially central portion, a second end portion rotatably connected to an outer shell segment at an intermediate portion of said shell assembly, and inner side portions increasingly spaced apart and outwardly extending from said first end portion to said second end portion, wherein said intermediate portion is spaced apart from said central portion, and said outer shell segment comprising a proximate end portion rotatably connected to said second end portion, and outer side portions increasingly spaced apart and outwardly extending from said proximate end portion to a terminal end portion of said outer shell segment, wherein said inner shell segment is configured to rotatably articulate in a first angular direction at a substantially constant circumferential angle about said first end portion to circumferentially overlap said inner side portions with adjacent inner shell segments, and wherein said outer shell segment is configured to rotatably articulate about said second end portion in a second angular direction opposite to said first angular direction to circumferentially overlap said outer side portions with adjacent outer shell segments.

2. The structure of claim 1, wherein said inner shell segment further comprises an inner strut disposed on a back surface of said inner shell segment, and wherein said inner strut comprises said first end portion rotatably connected to a first end of an adjacent inner shell segment in said substantially central portion.

3. The structure of claim 1, wherein said outer shell segment further comprises an outer strut disposed on a back surface of said outer shell segment, and wherein said outer strut comprises a proximate end portion operatively connected to said inner shell segment at said intermediate portion of said shell assembly.

4. The structure of claim 1, wherein at least one of said inner shell segment and said outer shell segment comprises a curved surface comprising a first curvature on a front surface.

5. The structure of claim 4, wherein at least one of said inner shell segment and said outer shell segment comprises a dual curved surface comprising a second curvature on said front surface.

6. The structure of claim 1, wherein each shell assembly comprises a curved surface comprising a complex curvature on a front surface.

7. The structure of claim 1, wherein at least one of said inner shell segment and said outer shell segment comprises a stiffness resiliency to elastically store strain energy of the respective said inner shell segment and said outer shell segment when respective inner side portions with adjacent inner shell segments and outer side portions with adjacent outer shell segments are disposed to overlap by a restraining force, and wherein said at least one of said inner shell segment and said outer shell segment is configured to release said stored strain energy to deploy said plurality of shell assemblies radially outward from said overlap position when said restraining force is withdrawn.

8. The structure of claim 7, wherein the at least one of said inner shell segment and said outer shell segment is configured to release said stored strain energy to deploy the at least one of said inner shell segment and said outer shell segment to a predetermined curvature.

9. The structure of claim 1, wherein the plurality of radially disposed shell assemblies are configured to articulate between a first configuration of a parabolic surface structure and a second configuration of a cylindrical folded structure.

10. The structure of claim 1, wherein said inner shell segment rotated in said first angular direction is disposed to extend in a substantially axial direction substantially transverse to said substantially central portion and said outer shell segment rotated in said second angular direction is disposed to extend in said substantially axial direction, and wherein said terminal end portion is disposed substantially adjacent to said first end portion.

11. The structure of claim 1, further comprising a constraint to restrain said outer shell segment in said axial position to form a cylindrical folded structure, wherein said inner side portions comprise a first angularly increasing perimeter extending in the radial direction from said substantially central portion, wherein said outer side portions comprise a second angularly increasing perimeter extending in the radial direction from said intermediate portion, wherein said each shell assembly comprises an outwardly extended shape comprised of said first and second angularly increasing perimeters, and wherein said second angularly increasing perimeter is disposed in an axial spiral in said cylindrical folded structure.

12. The structure of claim 1, wherein the plurality of radially disposed shell assemblies are configured to reflect electromagnetic energy at a focal region.

* * * * *